United States Patent [19]

Sung

[11] Patent Number: 4,875,886

[45] Date of Patent: Oct. 24, 1989

[54] HULA DOLL HAVING COMPOUND MOTIONS

[76] Inventor: Rak M. Sung, 225 Kaiulani Ave., Apartment 505, Honolulu, Hi. 96815

[21] Appl. No.: 246,691

[22] Filed: Sep. 20, 1988

[51] Int. Cl.[4] ..... A63H 13/04; A63H 3/28

[52] U.S. Cl. ..... 446/298; 446/354; 40/419

[58] Field of Search ..... 446/298–300, 446/303, 352–354, 358, 335, 336, 359, 366; 40/414, 418–420

[56] References Cited

U.S. PATENT DOCUMENTS

| | | | |
|---|---|---|---|
| 1,537,484 | 5/1925 | Meehan | 446/299 X |
| 2,154,121 | 4/1939 | Bold | 446/354 X |
| 2,669,064 | 12/1948 | Stewart | 446/330 |
| 2,724,926 | 11/1955 | Fisher | 446/353 |
| 2,727,334 | 12/1953 | Ostrander | 446/330 |
| 2,820,323 | 1/1958 | Reiser | 446/353 X |
| 2,894,356 | 7/1959 | Sala | 446/298 |
| 2,974,440 | 3/1961 | Clark | 446/354 X |
| 3,858,353 | 1/1975 | Glass et al. | 446/354 |
| 4,040,206 | 8/1977 | Kimura | 446/352 |
| 4,545,775 | 10/1985 | Kim | 446/299 |
| 4,676,764 | 6/1987 | Nam | 446/298 |

FOREIGN PATENT DOCUMENTS

| | | |
|---|---|---|
| 1299659 | 12/1962 | France . |
| 1358555 | 7/1964 | France . |

*Primary Examiner*—Mickey Yu

*Attorney, Agent, or Firm*—Spencer & Frank

[57] ABSTRACT

A hula doll including a base, a support shaft which is rotatably connected to and supported by the base, a doll body pivotably connected to the support column, a device for moving the doll body about the pivot, a device for rotating the support column relative to the base, and a device for pivoting the arms relative to the doll body.

12 Claims, 3 Drawing Sheets

HULA DOLL HAVING COMPOUND MOTIONS

BACKGROUND OF THE INVENTION

Field of the Invention

The present invention relates to a hula doll having compound motions, and to a mechanism for producing these compound motions.

A variety of animated figures or dolls having driving mechanisms are known, and are discussed hereunder. For example, in U.S. Pat. No. 4,545,775 to Kim, a dancing hula doll is shown which is actuated by an oscillating arm member having a forked end which causes movement of the body of the figure due to engagement of the fork end with a pin connected to the body, thereby moving the hips left and right. The doll as a whole is thereby slowly rotated in a single rotational direction while a melody is played by a sound-producing device.

Ostrander, in U.S. Pat. No. 2,727,334, discloses a doll having an inertia mass which is connected to the arms and legs of the doll by a connecting linkage. Slight movements of the doll cause the limbs to move, due to relative movement between the body of the doll and the inertia mass.

Stewart, in U.S. Pat. No. 2,669,064, teaches an animated doll having a tiltable head and movable arms. The arms can be moved independently of the head by turning a control knob, while tilting of the head can be accomplished by operating the arms in a predetermined manner.

In U.S. Pat. No. 2,974,440 to Clark, a doll is shown having pivotable arms which can be actuated by pressing of respective linkage arms disposed in the torso of the doll, to cause pivoting of the arms about a shoulder axis.

In U.S. Pat. No. 2,894,356 to Campdera Sala, a dancing toy figure having a gear-driven mechanism is shown, for causing a vibrating motion of the figure and pivoting motion of arms of a figure. The arms are driven in opposite directions by a mechanical linkage.

Bold, in U.S. Pat. No. 2,154,121, shows another type of actuating linkage for arms of a figure toy. The arms are reciprocated by a linkage member, which in turn is driven by a spring-powered rotary member.

In U.S. Pat. No. 1,537,484 to Meehan, a rotatable doll is shown which is supported by a spring. The doll has arms which are separately controlled by a pair of cam followers. The cam followers track respective concentric cam pathways which are disposed on a moving base portion. The base is caused to rotate relative to the doll by a supporting turntable, while the doll portion is held in a stationary position.

In U.S. Pat. No. 4,676,764 to Yeu, a dancing doll is shown which alternately moves its hips left and right while simultaneously oscillating about a horizontal axis and producing a melody. A mechanical linkage drives the hips of the doll in a reciprocating manner relative to a base which itself is caused to rotate about a vertical axis in alternatingly opposite directions.

In French Pat. No. 1,358,555 to Decamps, a figure toy is shown having a head portion which is pivotably connected to a body portion. The figure toy includes separate additional supports provided for supporting the head portion and the body portion. A linkage reciprocally drives the body portion relative to a leg portion which is itself pivotably pinned to the body portion. This causes a compound movement of the body portion, the leg portion, and the head portion about parallel horizontal axes. In French Pat. No. 1,299,659 to Baumier, a doll is shown having a power drive means and mechanical linkages for causing doll arm movement about a pivot axis. A control linkage is caused to reciprocate by a pinned linkage driven by an eccentrically-mounted pin which is disposed on a rotating member.

It is therefore a problem in the prior art to produce an animated figure having realistic limb and body movements with relatively few internal moving parts.

SUMMARY OF THE INVENTION

It is an object of the invention to provide a hula doll which alternately sways left and right, raises and lowers its arms alternately, and which oscillates about a vertical axis alternately clockwise and counterclockwise.

The above and other objects are accomplished according to the invention by the provision of a hula doll including:

a base;

a support shaft which is rotatably connected to and supported by the base;

a doll body pivotably connected to the support column;

a device for moving the doll body about the pivot;

a device for rotating the support column relative to the base; and a device for pivoting the arms relative to the doll body.

It is also an object of the invention to provide a doll having an operating mechanism which simultaneously drives the arms in opposite directions while also causing swaying of the body portion of the figure about a pivot point.

It is a further object of the invention to provide an animated figure or doll which oscillates about a vertical axis in clockwise and counterclockwise directions, wherein the actuating mechanism includes a rotating member having an eccentrically-mounted pin which is constrained to move within a slot of a support base of the figure, thereby causing the oscillating of the figure or doll relative to the support.

The hula doll according to the invention is actuatable so as to simultaneously have three different types of motion. In particular, the hula doll has a body portion which has a first type of motion wherein it sways from right to left about a pivot point located in a stationary interior upper torso portion thereof. A second type of motion is a relatively slow clockwise and counterclockwise oscillation of the entire doll about a vertical axis. As a third form of motion, the arms of the doll wave up and down in generally opposite directions of rotation about the shoulders of the doll. A sound-producing device is also provided.

A battery is provided to operate a motor which is supported by a base, the motor operating the doll via a series of gears and linkages. A disk having an eccentrically mounted pin is rotated by the motor, and the pin is constrained to reciprocate within a slot which is in a stationary portion of the base, thereby causing the pin to drive the disk to slowly oscillate. Since the disk is supported on a movable portion of the base which supports the doll, the entire doll slowly oscillates. The left and right swaying of the doll, as well as the waving of the arm, is caused by a linkage reciprocally driven by the gear assembly. A single linkage is eccentrically connected to a rotatable disk and to a lower arm of a crossshaped member which is centrally pinned to a stationary portion of a support member which supports the doll. Another linkage arm connects a portion of the cross-shaped member to an interior portion of the doll, so as to cause the swaying motion when the cross-shaped member oscillates about its pivot point Two opposed side arms of the cross-shaped member oscillate about the pivot point and are respectively connected via linkage members to control pins eccentrically mounted on bearing portions which support the arms in the interior of the doll. The control pin of each arm is connected by a respective linkage member to the opposed side arm of each respective cross-shaped member. Each control pin is disposed so that upward and downward movement of the respective linkage member causes oppositely-directed pivoting movement of the arms, since the opposed side arms have oppositely-directed movement due to pivoting of the arms of the cross-shaped member about the central pin.

DETAILED DESCRIPTION OF THE PREFERRED EMBODIMENT

Figure 1:
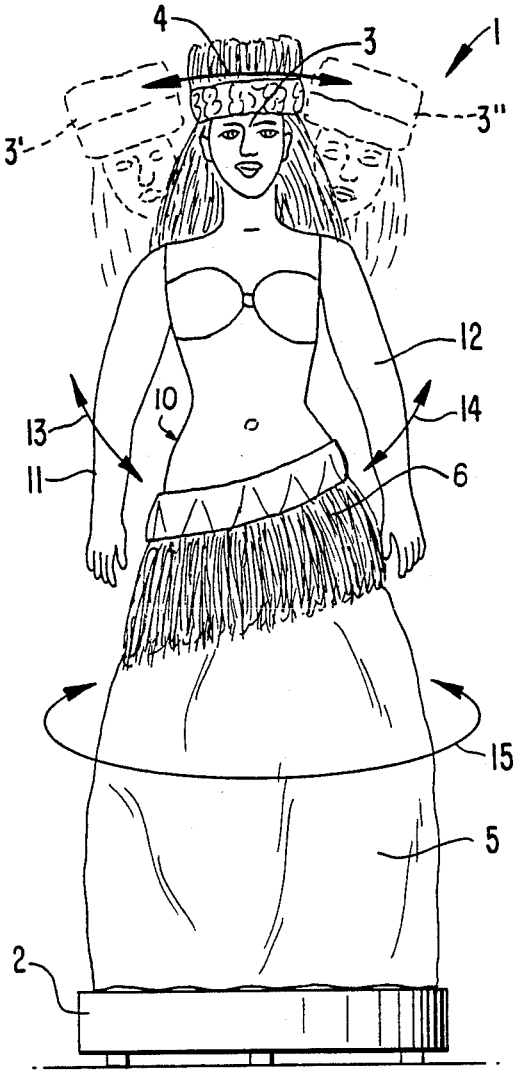
FIG. 1 is a front elevational view of a hula doll according to the invention.

As seen in FIG. 1, a hula doll 1 is supported on a base 2. The hula doll has an upper body including a head 3, a torso portion (unnumbered), a hip portion 10, and a pair of arms 11 and 12. A skirt 5 is connected to the hip portion 10 and covers an operating mechanism (described hereunder). A strip material 6 in the preferred embodiment completely covers the

Figure 2:
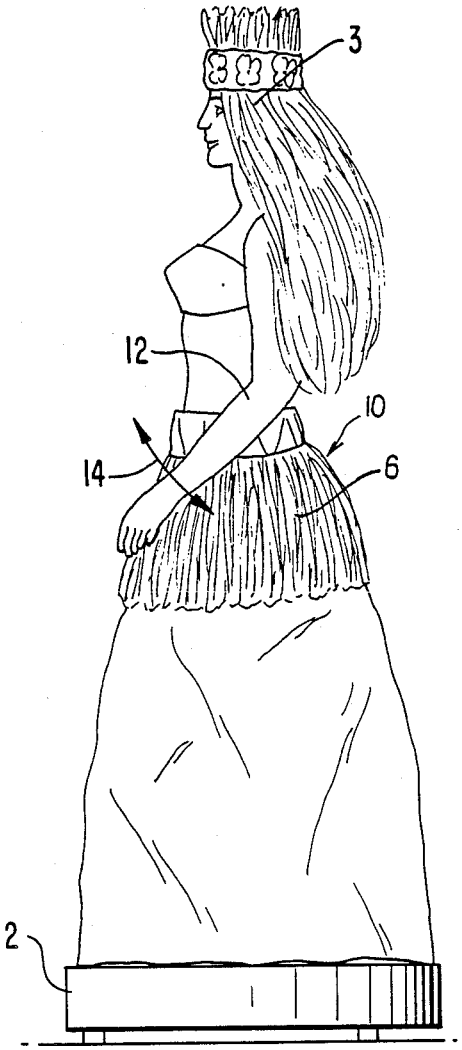
FIG. 2 is a side elevational view of the hula doll as seen from the right of FIG. 1.
Figure 3:
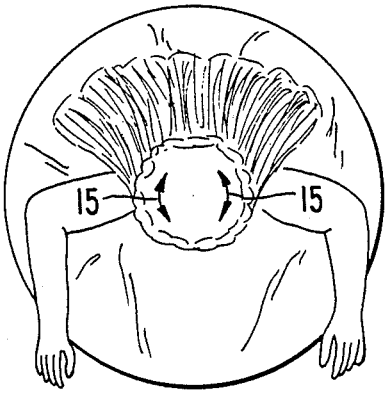
FIG. 3 is top elevational view of the hula doll as seen from the top of FIG. 1.

5, the strip material 6 being shown in FIGS. 1–3 broken away at its lower edge to reveal the skirt 5. The strip material 6 preferably extends downwardly to completely cover the skirt 5 to give the overall appearance of a traditional Hawaiian grass skirt. The skirt 5 is preferably composed of cloth, while the strip material 6 is preferably composed of strips of cellophane or the like.

The hula doll 1 has two major body motions relative to the base 2. The first type of motion is a pivoting motion, wherein the doll pivots within a vertical plane containing the shoulders of the hula doll 1 about a horizontal pivot axis generally passing through a pin 38 (FIG. 4) in the interior of the torso portion of the hula doll 1 and extending generally orthogonally to the vertical plane containing the shoulders. The horizontal pivot axis is preferably disposed to pass through the approximate center of the chest. The resultant pivoting motion of the entire doll body is suggested by the pivoting motion of the head 3 which is indicated by a double-headed arrow 4 in FIG. 1, with the pivoting motion being indicated in phantom outline in FIG. 1, showing a leftmost position of the head 3' and a rightmost position of the head 3''. The hip portion 10 moves correspondingly in a clockwise and counter-clockwise direction about the horizontal pivot axis, with the motion of each of the hips 10 of the hula doll 1 being respectively indicated by double-headed arrows 13 and 14. The hula doll also oscillates clockwise and counterclockwise about a vertical axis as indicated by the double-headed arrow 15 through an angle which is arbitrarily determined, and can be, for example, an angle in a range of 10 to 360 degrees, and preferably about 120 degrees.

FIG. 2 is a side elevational view of the hula doll 1, showing a side view of the arm 12. A third motion of the doll is the raising and lowing of the arms 12 and 13 in opposite relative directions. The motion of the arm 12 is indicated by the double-headed arrow 14. The angle through which the arms 11 and 12 travel can be arbitrarily selected with any range up to approximately 180 degrees in a preferred embodiment and can be selected to be, for example, an angle of 90 degrees.

FIG. 3 shows a top elevational view of the hula doll 1. The angular rotation of the hula doll 1 is indicated by the double-headed arrows 15, which correspond to the double-headed arrow 15 shown in FIG. 1. As suggested by FIG. 1, the hula doll 1 could oscillate from a center position in a clockwise direction through an angle of approximately 60 degrees, and then oscillate in a counterclockwise direction back through the center position and continuing on through an angle of 60 degrees, after which it returns to the center position, this cycle continuing while the hula doll 1 is operated as described hereunder.

Figure 4:
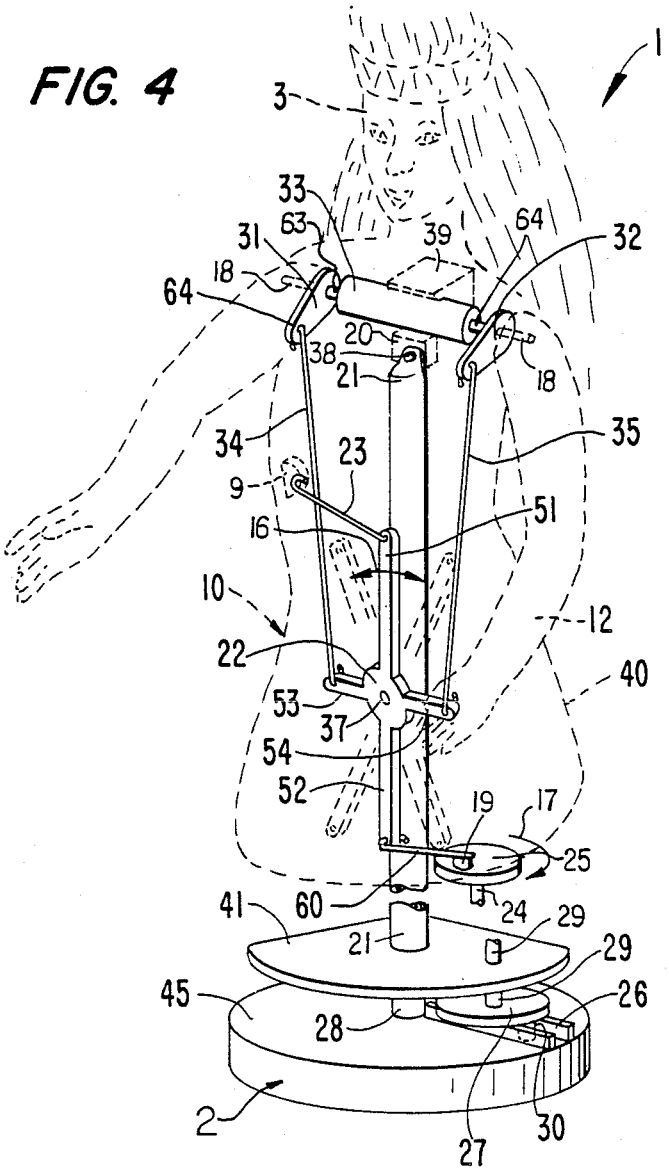
FIG. 4 is a schematic perspective view, with the hula doll figure shown in phantom outline, showing the operating mechanism which actuates the hula doll.

The hula doll 1 is shown in phantom outline in FIG. 4 along with a schematically-illustrated operating mechanism described hereunder. A lower support column 28 is a pivotable supports for a support column 21 and a lower platform wall 41. Although the lower support 28 is shown in FIG. 4 as being colinear with the support column 21, the lower support 28 can be offset relative to the support column 21. The support column 21 is tapered at its top end and is pivotably connected to a mount 20 by the pin 38, the mount 20 being fixedly connected to a hula doll body shell 40. The support column 21 pivotably supports a cross-shaped member 22 by a pin 37.

The arms 11 and 12 are driven in their alternating upward and downward motions as follows. A disk 25 rotates about a shaft 24 which rotates within a support 42 (shown in FIG. 7). The disk 25 revolves about the axis of the shaft 24 and also oscillates as a unit with the lower platform wall 41. The disk 25 carries an upstanding axle 19 which pivotably supports one end of a linkage arm 60. The other end of the linkage arm 60 is pivotably connected to a lowermost end of an arm 52 of the cross-shaped member 22. Since the cross-shaped member 22 is constrained to pivot about the pin 37, the circular motion of the axle 19, acting via the linkage arm 60, causes alternating pivoting motion of the cross-shaped member 22 to the phantom outlined positions indicated by a double-headed arrow 16. The cross-shaped member 22 has a pair of oppositely-extending side arms 53 and 54. The distal end of the side arm 53 is pivotably connected to a linkage arm 34. The distal end of the side arm 54 is pivotably connected to linkage arm 35. The other ends of the linkage arms 34 and 35 are respectively connected to respective ends of control arms 31 and 32. The control arms 31 and 32 respectively actuate the arms 11 and 12 via respective rods 18 and 18', which are shown in phantom outline.

Each of the control arms 31 and 32 are pivotably supported by a bearing member 33 via respective axles 63 and 64. The bearing member rotatably receives each of the axles 63 and 64 independently of each other so that the arms 11 and 12 can pivot in opposite rotational directions. The bearing member 33 is fixedly connected to the shell 40 by a bearing mount 39. When the cross-shaped member 22 pivots, the arms 53 and 54 of the cross-shaped member 22 pull the respective linkage arms 34 and 35 in opposite directions, that is, when the linkage arm 34 moves upwardly, the linkage arm 35 moves downwardly, and vice versa. With this type of linkage mechanism, the angle of travel of either of the arms 11 and 12 is determined by the respective links of the arms 53 and 54 of the cross-shaped member 22 and the length of the respective control arms 31 and 32. Depending upon the relationship between these lengths, the arms 11 and 12 can each travel through an angle of nearly 180 degrees.

Pivoting of the cross-shaped member 22 causes left and right movement of an arm 51 thereof, which is generally vertically oriented. The distal end of the arm 51 is pivotably connected to one end of a linkage 23, the other end of which is connected to a lug 9, which is shown in phantom outline in FIG. 4. The lug 9 is fixedly connected to the body shell 40. The left and right movements of the arm 51 are thereby translated into left and right movements of the lug 9, which in turn causes pivoting of the entire body shell 40 about the pivot pin 38. The head 3 and the hips 10 of the hula doll 1 are thereby caused to sway during the pivoting of the body shell 40 about the pivot pin 38 relative to the support column 21.

The hula doll 1 is caused to oscillate about a vertical axis as discussed hereinabove by the action of a disk 27 having a pin 30 which is guided by a slot 26. The disk 27 has a shaft 29 which transmits rotary motion to the disk 27 and thereby causes the pin 30 to oscillate linearly along the slot 26. Since the pin 30 is eccentrically mounted on the disk 27, the constrained linear path of the pin 30 causes the disk 27, and with it the lower platform wall 41 and the support column 21, to oscillate clockwise and counterclockwise about the center of pivoting of the support column 21.

Figure 7:
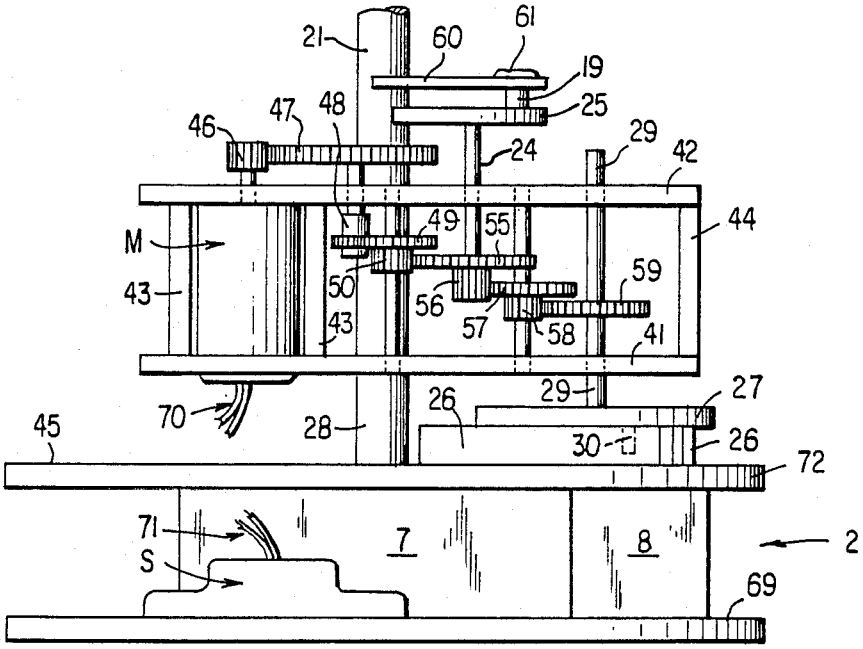
FIG. 7 is a front elevational view of the driving mechanism and support structure for the hula doll.

A portion of the support column 21 has been removed in FIG. 4, as well as a portion of the oscillating platform and drivetrain structure. Also, shafts 24 and 29 are broken away in FIG. 4. FIG. 7, discussed hereunder, shows a drivetrain structure as well as the broken-away portions and omitted portions of the oscillating platform of FIG. 4.

Figure 5:
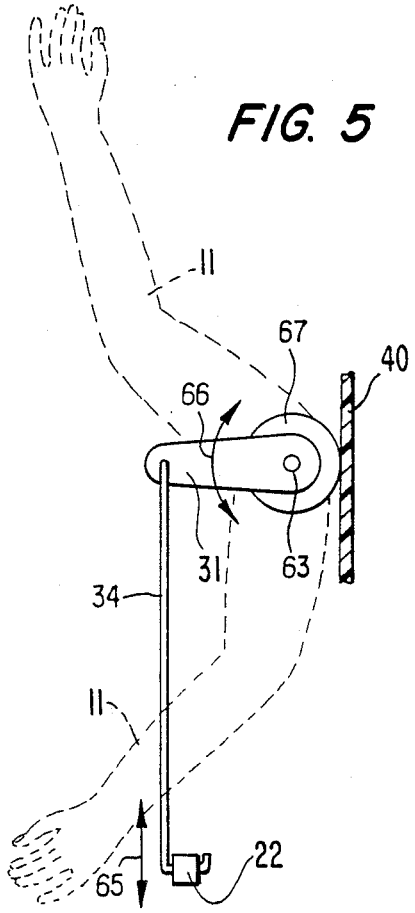
FIG. 5 is a schematic side elevational view of an arm operating mechanism, with the arm shown in phantom outline.

FIG. 5 is a schematic section view taken through the axle 63 illustrating how pivoting of the arm 11 occurs during movement of the linkage arm 34 in the upward and downward directions as indicated by a double-headed arrow 65. The arm 11 is thereby caused to rotate between the dotted-outlined positions shown in FIG. 5. The control arm 31 is fixedly connected by the rod 18 (shown in FIG. 4) to a disk 67. The disk 67 is fixedly connected to the arm 11 to cause movement therewith. A portion of the body shell 40 is shown in section and broken-away in FIG. 5.

Figure 6:
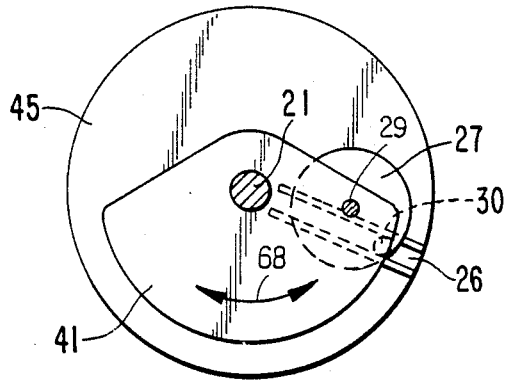
FIG. 6 is a schematic top sectional view through a support member showing the mechanism for causing oscillatory motion.

FIG. 6 is a top sectional view taken through the shaft 21 showing the lower platform wall 41 and the surface 45 in elevation. In FIG. 6, the groove 26 is seen partially in solid outline and partially in dotted outline having two upstanding parallel walls which slideably receive the pin 30. The clockwise and counterclockwise oscillation of the lower platform wall 41 is indicated by a double-headed arrow 68. The shaft 29 is also shown in section.

FIG. 7 is a side elevational view of the drive mechanism for driving the rotary motion of the disks 25 and 27. A speaker S is shown supported by a base wall 69, the speaker S having a pair of leads 71 which are broken-away. The speaker S is preferably a conventional speaker which forms a part of a conventional sound-producing means which plays back a stored sound pattern, such as a melody or a voice, the stored sound pattern being stored on magnetic tape, on an optical or magnetic disk, or electronically in a circuit. The stationary base 2, as seen in FIG. 7, includes a lower plate 69 supporting upstanding walls 7 and 8, which in turn support an upper plate 72. The upper plate 72 supports the lower support column 28, which in turn pivotably supports the lower platform wall 41 and the support column 21. The wall 41 carries a motor M. An upper platform wall 42 is fixedly connected to the lower platform wall 41 by a wall 43 and a wall 44.

The shaft 29 carries a toothed gear 59 which is driven by rotation of a toothed gear 58. The gear 58 is connected on a shaft together with a toothed gear 57, which is drivingly connected with a toothed gear 56. The toothed gear 56 is mounted on the shaft 24 together with a toothed gear 55. Rotation of the shaft 24 causes rotation of the disk 25. The toothed gear 55 is driven by a toothed gear 50 which is mounted together with a toothed gear 49 on a common shaft. The toothed gear 49 is in turn driven by a toothed gear 48, which rotates together with a toothed gear 47 on a common shaft. The toothed gear 47 is driven by an output gear 46 of the motor M. The motor M can be energized by a battery (not shown) or by another type of power source.

It will be understood that the above description of the present invention is susceptible to various modifications, changes and adaptations, and the same are intended to be comprehended within the meaning and range of equivalence of the appended claims.

What is claimed is:

1. A hula doll, comprising:

a base;

a support column which is rotatably connected to and supported by said base;

a doll body pivotably connected to said support column, said doll body including a pair of arms which are rotatably connected to said doll body;

means for pivotably moving said doll body about a pivot which is supported by said support column, said means for pivotably moving said doll body about said pivot including a linkage arm and means for moving one end of said linkage arm in a generally reciprocatory motion, said linkage arm having another end connected to said body;

means for rotating said support column relative to said base; and means for pivoting said arms relative to said doll body.

2. A hula doll as claimed in claim 1, wherein said means for rotating said support column comprises a motor for supplying motive power to move said support column relative to said base.

3. A hula doll as claimed in claim 1, wherein said means for moving one end of said linkage arm comprises a pivotably mounted member and a reciprocatory driving means for imparting reciprocatory motion to said pivotably mounted member about its pivot point.

4. A hula doll as claimed in claim 3, wherein said reciprocatory driving means comprises a rotatable body having an eccentrically disposed projection thereon and a linkage body which is rotatably connected at one end to said eccentrically disposed projection, the other end of said linkage body being connected to said pivotably mounted member.

5. A hula doll as claimed in claim 4, wherein at least one of said pair of arms of said doll body has a control arm connected thereto, and further comprising another linkage arm pivotably mounted at one end to said control arm, the other end of said another linkage arm being pivotably connected to said pivotably mounted member, whereby pivoting motion of said pivotably mounted member causes an oscillating motion of said at least one of said pair of arms of said doll body.

6. A hula doll as claimed in claim 1, wherein said means for rotating said support column relative to said base further comprises a rotatably-mounted member having an eccentrically-mounted projection thereon, said rotatably-mounted member being rotatably connected to said support column for movement therewith relative to said base, said eccentrically-mounted projection being received by a portion of said base so as to be constrained to follow a predetermined path relative to said base, whereby rotation of said rotatably-mounted member causes oscillation of said support column relative to said base.

7. A hula doll as claimed in claim 1, further comprising sound-producing means.

8. A hula doll as claimed in claim 4, wherein said pivotably mounted member comprises a crossshaped member having two side arms for imparting motion to respective ones of said arms of said doll body, a top arm which is pivotably connected to said linkage arm and a bottom arm which is connected to said reciprocatory driving means.

9. A hula doll, comprising:

a base;

a support column which is rotatably connected to and supported by said base;

a doll body connected to and supported by said support column;

means for rotating said support column relative to said base; and means for moving said doll body relative to said support column, said means for moving said doll body including a linkage arm having one end connected to said doll body and reciprocatory driving means for moving the other end of said linkage arm in a reciprocatory motion.

10. A hula doll as claimed in claim 9, wherein said doll body further comprises at least one pivotably-mounted doll arm having a control arm connected thereto, and further comprises a control linkage arm pivotably mounted at one end to said control arm, a pivotably mounted member connected to said other end of said linkage arm so as to be driven in pivoting motion by said reciprocatory driving means, the other end of said control linkage arm being pivotably connected to said pivotably mounted member, whereby pivoting motion of said pivotably mounted member causes an oscillating motion of said at least one pivotably-mounted doll arm.

11. A hula doll as claimed in claim 9, wherein said means for rotating said support column relative to said base further comprises a rotatably mounted member having an eccentrically-mounted member being connected to said support column for movement therewith relative to said base, said projection being received by said base so as to be constrained to follow a predetermined path, whereby rotation of said rotatably mounted member causes oscillation of said support column relative to said base.

12. A hula doll as claimed in claim 9, further comprising sound-producing means.

* * * * *